United States Patent [19]

Arakawa

[11] Patent Number: 4,527,147

[45] Date of Patent: Jul. 2, 1985

[54] HIGH VOLTAGE VARIABLE RESISTOR WITH IMPROVED CENTRAL SLIDER CONTACT CONSTRUCTION

[75] Inventor: Hajime Arakawa, Yokaichi, Japan

[73] Assignee: Murata Manufacturing Co., Ltd., Japan

[21] Appl. No.: 486,372

[22] Filed: Apr. 19, 1983

[30] Foreign Application Priority Data

Apr. 30, 1982 [JP] Japan ..... 57-73876

[51] Int. Cl.[3] ..... H01C 10/32; H01C 10/34

[52] U.S. Cl. ..... 338/162; 338/174; 338/184; 338/188; 338/202

[58] Field of Search ..... 338/162, 160, 164, 173–175, 338/188, 202, 48, 314

[56] References Cited

U.S. PATENT DOCUMENTS

| | | | |
|---|---|---|---|
| 3,585,559 | 6/1971 | Rozema et al. | 338/48 |
| 3,898,606 | 8/1975 | Dumas et al. | 338/48 |
| 3,909,769 | 9/1975 | Rozema et al. | 338/164 X |
| 3,961,302 | 6/1976 | Hufford | 338/48 X |
| 4,015,231 | 3/1977 | Seno et al. | 338/174 |

FOREIGN PATENT DOCUMENTS

| | | | |
|---|---|---|---|
| 1420779 | 1/1976 | United Kingdom | 338/162 |

OTHER PUBLICATIONS

Whitefield, "Low Cost, High Voltage Potentiometers", Electron (GB), #89, Feb. 12, 1976, pp. 51–52.

*Primary Examiner*—Roy N. Envall, Jr.
*Assistant Examiner*—C. N. Sears
*Attorney, Agent, or Firm*—Ostrolenk, Faber, Gerb & Soffen

[57] ABSTRACT

An arcuate film resistor is defined on an insulating substrate. During use, a high voltage is impressed across end terminals connected to the arcuate film resistor. A central electrode is located on the insulated substrate at a point which is surrounded by the film resistor. The central electrode is formed of a non-film resistor material and has superior adherability to the substrate. A disk-shaped film resistor is deposited at the center of the central electrode and second ring-like film resistor is formed around the outer periphery of the central electrode. A rotatable slider has a first contact positioned over the disk-shaped film resistor and a second contact which slides along the arcuate film resistor. A portion of the voltage from the arcuate film resistor can thus be transferred to the central electrode. The disk-shaped film resistor located on the central electrode improves the contact between the slider at the central electrode. The central electrode adheres better to the substrate and the centrally located film resistor provides better electrical contact. Because the central and outer film resistors are spacially separated, cracks that may develop in the central film resistor do not spread to the outer film resistor.

5 Claims, 6 Drawing Figures

HIGH VOLTAGE VARIABLE RESISTOR WITH IMPROVED CENTRAL SLIDER CONTACT CONSTRUCTION

BACKGROUND OF THE INVENTION

The present invention relates to a high-voltage variable resistor, suitable for use as a variable voltage divider for feeding a high voltage of several kilovolts to respectively focusing electrode in a cathode-ray tube of, for example, a color television receiver, and more particularly to a high voltage variable resistor with improved central slider contact construction.

A conventional high-voltage variable resistor used as a variable voltage divider, is fabricated on a rectangular insulating substrate 11 of alumina porcelain. The variable resistor comprises a film resistor 12 in the form of a circular arc which forms a variable resistance unit including film resistors 13 and 14 connected to both ends of film resistor 12. Together a stationary resistance unit is formed. A central electrode 15 is surrounded by the film resistor 12 and a slider (not shown) mounted on the flange at an end of rotary shaft slides across the film resistor 12 and the central electrode 15.

A terminal electrode 16 connected to one end of film resistor 13 is connected to a high voltage output of a fly-back transformer or the like and a terminal electrode 17 connected to one end of film resistor 14 is connected to a reference potential, such as ground. A terminal electrode 19 at the end of a film resistor 18 is connected to the central electrode 15 and forms a protective resistance adapted to conduct an attenuated high voltage from the voltage applied to the electrode 16. The film resistors 12, 13, 14 and 18 are formed of; cermet resistors each comprised of a mixture of electric conductive material, selected from the Ru group, Ag-Pd group or Rh group; glass frit for a binder or resistance value adjusting agent; and a filler, such as $Al_2O_3$, $TiO_2$ or $Bi_2O_3$, for adjusting the resistance value or resistance-temperature characteristic. The central electrode 15 and terminal electrodes 16, 17 and 19 comprise a conductive material, such As Ag, Ag-Pd group, or Ag-Pt group and, as necessary, a mixture thereof with glass frit. The content of glass frit of these components usually is about 10 to 40 percent by weight in the film resistor and about 0 to 10 percent by weight in electrode.

The central electrode 15 of conventional high voltage resistors is formed of Ag group, whereby the problem arises that the electrode 15 is subject to wear at its surface due to sliding motion of the slider. Oxidization at the surface after long use also increases contact resistance to the slider and creates the migration phenomenon which promotes a corona discharge between the electrode and the high voltage portion of the film resistor. To overcome these problems, it has been proposed to form the central electrode 15 of a material of which the film resistor 18 is made.

A central electrode constructed of film resistor, however, has a lower adhesive strength to the insulating substrate of alumina porcelain as compared to an electrode made with the Ag group material. Also, the film resistor is rich in glass constituent and is more fragile. When it is subjected to a frictional force or the press-contact force of slider it is likely to develop cracks after prolonged use. The cracks created at the center of the film resistor which forms the central electrode extends to the periphery thereof and is likely to generate corona discharges. Also, when the central electrode is brought into contact with the terminal of a resistance meter in the inspection process or the like, the contact resistance is larger and results in inaccurate measurement of resistance.

SUMMARY OF THE INVENTION

It is an object of the present invention to provide a high-voltage variable resistor with improved central slider contact construction to improve the wear resistance of the central electrode and to prevent generation of corona discharges caused by the migration phenomenon or creation of cracks.

Another object of the present invention is to provide a high-voltage variable resistor whose resistance can be measured with accuracy during an inspection process or the like.

These and other objects of the invention will become more apparent in the detailed description and examples which follow.

DETAILED DESCRIPTION OF THE DRAWINGS

Figure 1:
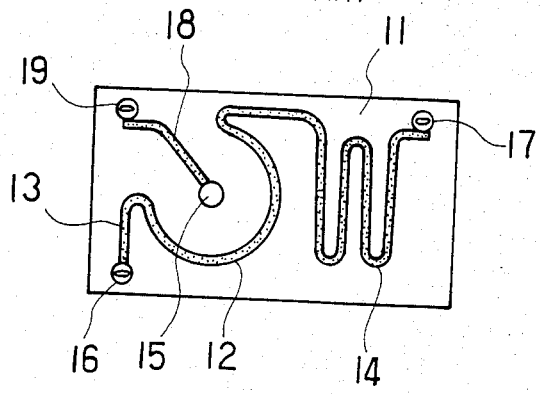
FIG. 1 PRIOR ART
FIG. 1 is a plan view of an insulating substrate on which is deposited a film resistor used in a prior art high-voltage variable resistor.
Figure 2:
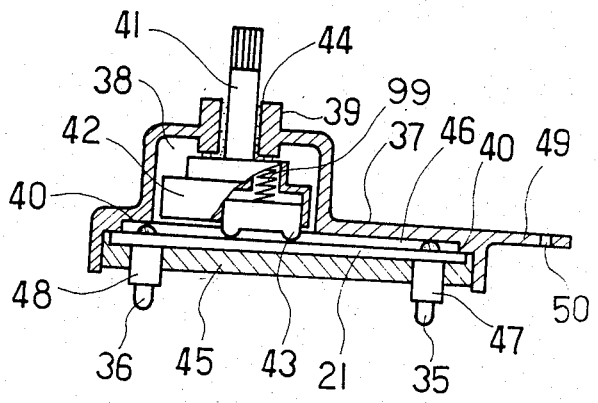
FIG. 2 is a sectional view of a portion of an embodiment of a high-voltage variable resistor of the present invention.
Figure 3:
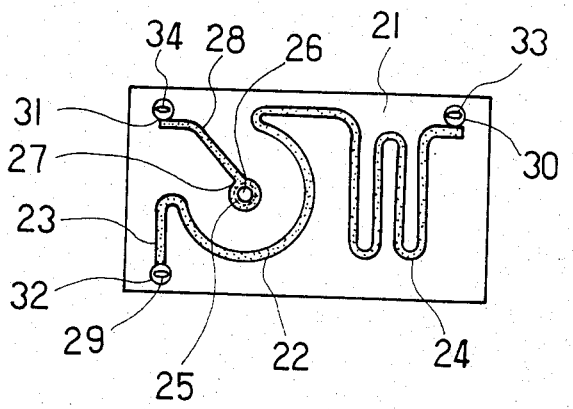
FIG. 3 is a plan view of an insulating substrate on which is deposited a film resistor used in the variable resistor of the invention.
Figure 4:
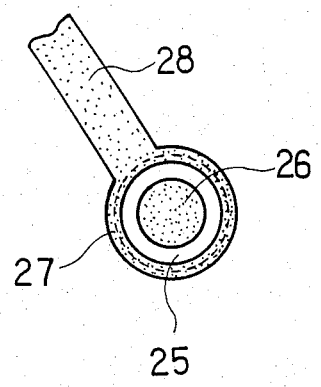
FIG. 4 is an enlarged view of a portion of the film resistor located on the insulating substrate in FIG. 3.
Figure 5:
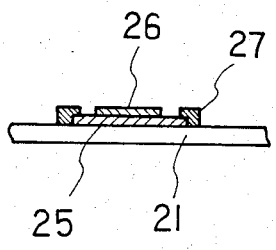
FIG. 5 is a longitudinal sectional view of a principal portion of the film resistor in FIG. 4.

Referring to FIGS. 2 and 3, a rectangular insulating substrate 21 is formed of alumina porcelain or the like. On the surface of the substrate 21 is integrally deposited a film resistor 22 arcuately shaped and forming a variable resistance unit. Film resistors 23 and 24 are connected to opposite ends of film resistor 22 to form a stationary resistance unit. A central electrode 25 of electrically conductive material is deposited at the center of film resistor 22 and film resistors 26 and 27, as shown in FIGS. 4 and 5, are deposited separately from each other within a region where a slider to (be discussed below) slidably moves on the central electrode 25 and a region across the peripheral portion of the central electrode and the insulating substrate 21 surrounding the peripheral portion of electrode 25.

The film resistor 26 is in the form of a disk located centrally over the electrode 25. The film resistor 27 being annularly surrounds the central electrode 25.

In FIGS. 2 and 3, there is shown a film resistor 28 formed as a protective resistor which is continued with the annular film resistor 27 and which is integral therewith. Terminal electrodes 29, 30, and 31 are deposited on the substrate 21 and connected to one respective end of film resistors 23, 24 and 28.

The above film resistors and electrodes are made from the same material as conventional parts and are printed on the substrate 21 by a screen printing, process or the like and are thereafter baked at a temperature of 600° to 950° C.

Through holes 32, 33 and 34 are formed on the substrate 21 approximately at the center of each electrodes 29, 30 and 31, respectively. Terminals 35 and 36 are inserted through the through holes 33 and 34. The terminals 35 and 36 are connected at one end thereof to the terminal electrodes 30 and 31 through soldering or electrically conductive binder, thereby drawing one end of each film resistor 24 or 28 out of the rear surface of substrate 21. In addition, a terminal (not shown) is similarly inserted into the through hole 32, thereby making one end of film resistor 23 electrically accessible.

Referring to FIG. 2, an insulating casing 37 is open at one side. The insulating substrate 21 is mounted to the bottom of casing 37 and opposite thereto at the surface carrying the film resistors. A cylindrical cavity 38 and a bearing portion 39 communicating therewith are provided at the casing 37 and positioned opposite to the arcuate film resistor 22 located on the insulating substrate 21. In addition, the substrate 21 is mounted onto the base within casing 37 in such a manner that a rib 40 is projected from the inner bottom surface of casing 37 and positioned corresponding to the overall periphery of substrate 21, the substrate 21 being placed on the rib 40 and adhered thereto by means of an adhesive on an outer periphery or at several suitable positions.

Reference numeral 41 designates a rotary shaft inserted through the bearing portion 39 at the casing 37. The rotary shaft 41 has a flange 42 disposed within the cavity 38 at the casing 37 and its lower surface includes a recess into which a slider 43 is mounted elastically by use of a spring. The slider 43 rotates about the film resistor 26 coated on the central electrode 25 at the substrate 21 and slides on the arcuate film resistor 22. Incidentally, grease 44 is applied between the rotary shaft 41 and the bearing portion 39, thereby keeping the casing 37 airtight and smoothing the rotatability of the rotary shaft 41.

Also, reference numberal 45 designates an epoxy resin filling the opening of casing 37 at its rear side surface. It is cured, so that an airtight gap 46 is formed between the inner surface of the bottom of casing 37 and the surface of substrate 21 carrying the film resistor. Sleeves 47 and 48 are fitted onto the terminals 35 and 36 respectively, and serve to mechanically reinforce thereof and improve insulating strength; 49 designates a fixture for mounting the variable resistor to another apparatus; a through hole 50 is made available through which a screw or similar device is inserted to reach the fixture 49.

The high-voltage variable resistor constructed as described above is connected at the terminal electrode 29 to, for example, the high voltage output end of the fly-back transformer and at the terminal electrode 30 to a reference potential, such ground. Thus a high voltage is present at the terminal electrode 31 can be supplied to, for example, the focus electrode of a cathode-ray tube.

Figure 6:
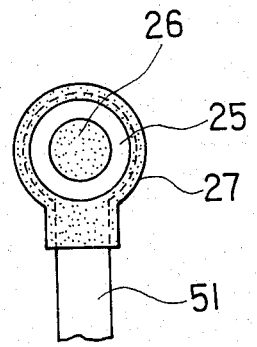
FIG. 6 is an enlarged view showing the pattern of a portion of a modified embodiment of the film resistor.

The high-voltage variable resistor of the invention is characterized in that the film resistors 26 and 27 are desposited on the substrate 21 separate from each other within the range wherein the slider on the central electrode 25 slides and around the periphery of central electrode 25 and the surrounding portion thereof. Alternatively, in a case where the protective film resistor 28 is not required, an electrically conductive film 51, as shown in FIG. 6, need only be formed of the same material as the central electrode 25 and be substituted for the film resistor, thereby depositing the film resistors 26 and 27 the same as those in the afore-said embodiment. Also, the film resistors 22, 23 and 24 may be formed in a desirable pattern, in which an arcuate film resistor form the separate variable resistance unit may be connected in continuation of the film resistor 22 for taking out voltage to be given to the screen electrode at the cathode-ray tube, thereby forming a duplex variable resistor.

In this case, two sliders and two rotary shafts of course are required and the insulating casing 37 must be capable of housing the duplex resistor. Furthermore, the means for fixing the insulating substrate 21 to the casing 37 may alternatively use projections provided therein and fuse them for this purpose. Also, various well-known modifications of the invention are possible, in which the simplest construction is that only the rotary shaft having the slider may be mounted at the predetermined position on the substrate on which the film resistors and electrodes are deposited, and the film resistors may be exposed.

As seen from the above, the variable resistor of the invention, which allows the slider to slide across the aforesaid central electrode and film resistor, has the film resistors deposited on the substrate separately from each other and within the range where the slider slides on the electrode. The second film resistor 27 is deposited around the peripheral portion of the central electrode and a portion on the substrate surrounding the peripheral portion of central electrode, thereby improving wear resistance and restraining generation of migration phenomenon.

Thus, a superior central electrode which adheres better to the film resistors and to the insulating substrate is obtained. The central electrode increase adhesability to the substrate and also serves as a buffer to prevent cracks. Even when a crack is created in the film resistor 26 within the range of sliding movement of the slider, the crack does not extend to the surrounding film resistor because the film resistor is separated from the film resistor surrounding the central electrode. As a result, no corona discharge occurs to degrade the reliability of the resistor. Furthermore, the exposed area of the central electrode 25 can be contacted by a resistance meter, thereby enabling accurate measurement.

While a preferred embodiment of the invention has been described using specific terms, such description is for illustrative purpose only, and it is to be understood and changes and variations may be made without departing from the scope or spirit of the following claims.

What is claimed is:

1. A high voltage variable resistor comprising:

an insulating substrate;

an arcuate film resistor defined on said insulating substrate;

an electrically conductive central electrode located at said substrate and formed of a mixture of glass frit and a conductive material selected from the group Ag, Ag-Pd and Ag-Pt, the glass frit comprising about 0 to 10 percent by weight of said mixture, said electrode being substantially surrounded by said arcuate film resistor;

a central film resistor located on but not fully covering said central electrode;

an outer film resistor surrounding said central electrode and overlapping the circumferential periphery of said central electrode, said outer film resistor being spacially separated from said central film resistor whereby cracks which may develop in said first film resistor are not transmitted to said outer film resistor; and a slider having a first rotatable contact electrically contacting said central film resistor and being slidably rotatable thereabove and a second contact which is adapted to slide along said arcuate film resistor when said slider is rotated.

2. The variable resistor of claim 1 further including an electrical conductor located on said insulating substrate and electrically connecting said central electrode to a terminal electrode located away from said central electrode, said conductor being formed of a film resistor material.

3. A high voltage variable resistor as in claim 1, further including an electrical conductor located on said insulating substrate and electrically connecting said central electrode to a terminal electrode located away from said central electrode, said electrical conductor being formed of the same material as said central electrode, and wherein said outer film resistor includes a film resistor portion which extends from said outer film resistor and is coextensive with said electrical conductor.

4. The high voltage variable resistor as in claim 1, wherein said outer film resistor includes an annular portion which surrounds said central conductor and is located on said insulating substrate.

5. The high voltage variable resistor as in claim 1, wherein said central and outer film resistors comprise a mixture of glass frit, a filler selected from the group of $Al_2O_3$, $TiO_2$ and $Bi_2O_3$, and an electrically conductive material selected from the group of Ru, Ag-Pd and Rh, the glass frit comprising about 10 to 40 percent by weight of said mixture.

* * * * *